US009950830B2

(12) United States Patent
de Lesseux et al.

(10) Patent No.: US 9,950,830 B2
(45) Date of Patent: Apr. 24, 2018

(54) INSULATED LINERS AND CONTAINERS

(75) Inventors: Lionel de Bazelaire de Lesseux, Thomasville, GA (US); Robert Gary Stampfli, Tallahassee, FL (US); Langdon Strong Flowers, Thomasville, GA (US)

(73) Assignee: COLDKEEPERS, LLC, Thomasville, GA (US)

( * ) Notice: Subject to any disclaimer, the term of this patent is extended or adjusted under 35 U.S.C. 154(b) by 231 days.

(21) Appl. No.: 13/488,995

(22) Filed: Jun. 5, 2012

(65) Prior Publication Data

US 2012/0243808 A1 Sep. 27, 2012

Related U.S. Application Data

(63) Continuation-in-part of application No. 11/838,559, filed on Aug. 14, 2007, now Pat. No. 9,290,313.

(60) Provisional application No. 60/907,932, filed on Apr. 23, 2007.

(51) Int. Cl.

| | |
|---|---|
| ***B65D 5/00*** | (2006.01) |
| ***B65D 5/60*** | (2006.01) |
| ***B65D 81/38*** | (2006.01) |
| ***B65D 33/16*** | (2006.01) |

(52) U.S. Cl.
CPC ..... *B65D 5/60* (2013.01); *B65D 33/1683* (2013.01); *B65D 81/3897* (2013.01)

(58) Field of Classification Search
CPC ..... A45C 7/0077; A45C 11/20; A45C 13/02; B65D 81/3897; B65D 5/60; B65D 33/1683
USPC ..... 383/103, 105, 110, 113
See application file for complete search history.

(56) References Cited

U.S. PATENT DOCUMENTS

| | | | | | |
|---|---|---|---|---|---|
| 2,289,254 | A | * | 7/1942 | Eagles | 383/97 |
| 2,625,695 | A | * | 1/1953 | Nicholson | 5/413 R |
| 2,667,198 | A | * | 1/1954 | Klein | 383/97 |
| 2,795,258 | A | * | 6/1957 | Berry et al. | 190/106 |
| RE24,600 | E | * | 2/1959 | Ziff | 383/33 |
| 2,954,891 | A | * | 10/1960 | Imber | 383/20 |
| 3,074,250 | A | * | 1/1963 | Everett | 62/259.3 |
| 3,083,890 | A | * | 4/1963 | Ignell | 229/125.37 |
| 3,272,373 | A | * | 9/1966 | Alleaume et al. | 220/560.05 |
| 3,763,972 | A | * | 10/1973 | Karzmar | 190/8 |
| 3,980,225 | A | * | 9/1976 | Kan | 383/104 |
| 4,185,673 | A | * | 1/1980 | Daniello | 383/14 |
| 4,211,091 | A | * | 7/1980 | Campbell | 62/372 |
| 4,211,267 | A | * | 7/1980 | Skovgaard | 383/101 |

(Continued)

*Primary Examiner* — Peter Helvey
(74) *Attorney, Agent, or Firm* — Withers & Keys, LLC

(57) ABSTRACT

An insulated shipping liner includes a flexible sealed sack having a first layer and second layer sealed together about their outer peripheral edges to form a housing. An insulating layer made from a single sheet of foam material is located within the housing and is configured to be folded such that a first side portion, second side portion and middle portion create a substantially rectangular box form, with the first and second side portions defining opposing sides of the box form, the middle portion defining a bottom of the box form, the substantially rectangular top flap defining at least part of a top of the box form, and the opposing substantially rectangular first and second side flaps defining at least part of other opposing sides of the box form. The box form can be placed in a container to form an insulated container for shipping and/or storage.

20 Claims, 15 Drawing Sheets

(56) References Cited

U.S. PATENT DOCUMENTS

| | | | | | |
|---|---|---|---|---|---|
| 4,343,158 | A * | 8/1982 | Campbell | 62/372 |
| 4,468,933 | A * | 9/1984 | Christopher | 62/457.1 |
| 4,509,645 | A * | 4/1985 | Hotta | 206/545 |
| 4,528,694 | A * | 7/1985 | Skovgaard | 383/10 |
| 4,537,313 | A * | 8/1985 | Workman | 206/545 |
| 4,578,814 | A * | 3/1986 | Skamser | 383/99 |
| 4,595,101 | A * | 6/1986 | Rivera | 206/545 |
| 4,620,633 | A * | 11/1986 | Lookholder | 206/523 |
| 4,679,242 | A * | 7/1987 | Brockhaus | 383/4 |
| 4,854,736 | A * | 8/1989 | McVeigh | 383/76 |
| 4,892,226 | A * | 1/1990 | Abtahi | 62/371 |
| 4,988,216 | A * | 1/1991 | Lyman | 383/74 |
| 5,472,279 | A * | 12/1995 | Lin | 383/2 |
| 5,490,396 | A * | 2/1996 | Morris | 62/457.2 |
| 5,904,230 | A * | 5/1999 | Peterson | 190/107 |
| 6,056,439 | A * | 5/2000 | Graham | 383/103 |
| 6,068,402 | A * | 5/2000 | Freese et al. | 383/110 |
| 6,210,037 | B1 * | 4/2001 | Brandon, Jr. | 383/111 |
| 6,247,328 | B1 * | 6/2001 | Mogil | 62/457.2 |
| 6,513,974 | B2 * | 2/2003 | Malone et al. | 383/3 |
| 6,932,509 | B2 * | 8/2005 | Shah et al. | 383/103 |
| 7,364,360 | B2 * | 4/2008 | Urman et al. | 383/6 |
| 2001/0036520 | A1 * | 11/2001 | Hall | 428/35.5 |
| 2003/0179960 | A1 * | 9/2003 | Beaulieu | 383/53 |
| 2004/0136621 | A1 * | 7/2004 | Mogil | 383/110 |
| 2004/0252919 | A1 * | 12/2004 | Welch | 383/110 |
| 2005/0117817 | A1 * | 6/2005 | Mogil et al. | 383/110 |
| 2005/0281494 | A1 * | 12/2005 | Allen et al. | 383/109 |
| 2006/0126972 | A1 * | 6/2006 | Tighe et al. | 383/109 |
| 2006/0198562 | A1 * | 9/2006 | Mogil | 383/121.1 |
| 2007/0274613 | A1 * | 11/2007 | Pruchnicki et al. | 383/110 |
| 2009/0266910 | A1 * | 10/2009 | Hunter | 239/57 |

* cited by examiner

INSULATED LINERS AND CONTAINERS

CROSS REFERENCE TO RELATED APPLICATIONS

This application is a Continuation-in-Part of U.S. application Ser. No. 11/838,559, filed Aug. 14, 2007, which claims the benefit of U.S. Provisional Application No. 60/907,932, filed Apr. 23, 2007, the entire contents of which are incorporated herein by reference.

BACKGROUND OF THE INVENTION

1. Field of the Invention

This invention is directed to the field of thermal liners primarily used in the shipping or storage of goods, foodstuffs, samples and the like items that must be maintained within predetermined temperature ranges for predetermined periods of time in order to ensure the safety and quality of such items. More particularly, the invention is directed to collapsible insulated shipping liners designed to allow items held therein to be maintain within predetermined temperatures, either hot or cold, for extended periods of time. The shipping liners are ideal for long distance shipment of perishable items such as foods, samples and medical items, and may also be used for catering, take-out as well as for traditional cooler functions.

2. Discussion of the Prior Art

There are numerous industries wherein the safe transportation or shipment and storage of temperature sensitive products or samples is critical to the preservation of the products or samples. Medical supplies, samples, transplants and the like must often be maintained within controlled temperatures during periods of shipment from suppliers to users, providers to patients, and between operating facilities. With the popularity of online grocery shopping growing, there is also a need to improve upon insulated packaging for transporting goods such as frozen foods from temperature controlled environments to the end-consumers. Frequently, delivered packages may have to be left for extended periods in less than optimal ambient conditions before a consumer actually takes possession of the goods being shipped.

Currently, to maintain shipped items at optimal temperatures, options have been tried which include foam coolers, dry ice packs or boxes and insulated storage bags. Each of these options comes with drawbacks, including limited lengths of time for maintaining goods or items at optimal temperatures, environmental impact or safety concerns and increased shipping cost to cover container weight, size or express deliveries.

Foam coolers combined with dry ice packs can, in some instances, effectively maintain items at optimal temperatures. However, their use is costly in both supply costs and excess shipping costs. In addition, foam coolers have a negative impact on the environment and the handling of dry ice packs can raise safety concerns.

Dry ice packs have been used alone to ship and deliver perishable items. However, their ability to maintain optimal temperatures for extended periods of time while in a standard cardboard container is extremely poor.

Standard plastic bags have been used for short term transportation of perishable items. However, their use is limited to only conveyance of the item and not for maintaining the item in an optimal temperature range for any significant period of time, such as more than one to three hours or more.

In view of the foregoing, there is a need to provide insulated shipping liners that can provide greater insulating properties to ensure that goods, foodstuffs, medical supplies and samples and other items that are temperature sensitive may be safely shipped and maintained within necessary temperatures for greater periods of time than is possible using conventional shipping containers or liners.

There is a further need to provide insulated shipping and transportation liners that can also be compactly configured to reduce shipping and transportation costs without reducing the insulating properties thereof.

SUMMARY OF THE INVENTION

The present invention includes flexible or collapsible hot/cold storage or shipping liners that are preferably self configuring and/or supporting but easily manipulated to a reduced size to be placed in an outer container or box for shipment. In the preferred embodiments, the liners are formed of at least three layers of insulating materials including an outer metallic or radiate energy reflecting layer, an intermediate open cell foam insulating layer and an inner low thermal convection and food grade plastic layer.

In some embodiments, the liner is in the form of a fully flexible insulated bag, and the bag is designed to be used as stand-alone container capable of maintaining a supporting shape when placed on a support surface. However, the bag may also be placed into, or folded and subsequently placed into, an outer protective structure such as a cardboard container or box, a plastic bag or bin or any other shipping container. Due to the flexible insulating materials of the bags, they may be shaped to conform to, or reduce the spaced occupied within, outer containers, thereby maximizing shipping efficiencies and reducing shipping costs.

In one embodiment of the insulated bag liner, the inner layer is formed as a bag with an outwardly folded cuff at an opening therein such that the cuff frictionally receives and retains upper free end portions of opposing side walls of the intermediate insulation material therein. In this manner, the intermediate insulation material is mechanically secured to the inner layer such that both layers may be simultaneously inserted within the outer layer. This frictional retention of the intermediate layer within the cuff of the inner layer will also function to retain the intermediate insulating layer in place within the outer layer when the composite insulating bags of the invention are in use. In some embodiments, the upper end of the inner plastic bag layer is welded to the inner surface of the outer layer, at or spaced slightly below the upper edges of the outer layer. The outer layer, is also formed into a bag-like configuration by folding a length of material on itself, from end-to-end, and thereafter welding the opposite side edges together.

The composite or multi-layer insulated bags of the invention may also include different closure and handle structures. In some embodiments, the inner bag-like structures may be heat sealed at their upper open ends after articles or items are placed with the insulated bags. In other embodiments, mechanical zip-like closures or double sided tapes may be used to seal the upper open ends of the inner bags after articles or items are placed therein. In yet other embodiments, the inner bags may not be sealed. Preferably, the upper ends of the outer bag-like layers are provided with either heat seals or mechanical zip-like or friction lock seals. In some embodiments, the seals may be created using friction lock engaging handle members that are initially sealed to the upper edges of the opposing sides of the outer layer and which include components that interlock with one another as the handle members are locked together.

In some embodiments of the invention, to facilitate the compact handling and/or folding of the multi-layered insulated shipping and storage bags of the invention for shipment to wholesalers or end users for subsequent use, the interior of the bags, and especially the intermediate open cell foam layers are designed to be evacuated by the application of a partial vacuum. Such a vacuum may be applied to the bags through an opening between the outer layer and the intermediate open cell foam material thereof by use of a vacuum tube or by placing the bags within an enclosure under a reduced atmosphere or by physical compression of the bags. When the vacuum tube is withdrawn or the predetermined reduced pressure is obtained within the bags, the outer openings therein are closed by removable adhesive patches or covers to prevent ambient air from entering the bags. When the bags have been at least partially evacuated so that air is removed from the open cell foam and from between the outer layer and the foam, they are easily folded into compact configurations for storage or for shipment. When the bags are to be used by an end user, the patches or covers are removed and the bags will automatically expand as ambient air enters the vacuum openings therein. After the bags are inflated, the adhesive patches or covers may be reapplied to prevent contaminants from entering the openings therein. In this regard, when the insulated shipping and storage bags are to be used to ship or store items that must remain sterile, the vacuum processes and inflating processes may take place within sterile enclosures.

The compact handling of the multi-layered insulated shipping and storage bags of the invention for storage or shipment to wholesalers or end users for subsequent use may also be accomplished by placing one or more insulate bags within an outer plastic bag have one end with a sealable opening. Thereafter, the outer bag is mechanically collapsed to force most air out of the enclosed insulated shipping bags and the outer bag and the outer bag subsequently sealed. In some embodiments, a partial vacuum may be applied within the outer bag to reduce the pressure therein and to reduce the volume of the overall package.

Further, in the embodiments wherein the intermediate foam layers are seated or sealed with their upper edge portions within the cuffs of the inner layers and the cuffs sealed to the outer layer or wherein the upper edges of the inner layer are sealed to the outer layer to isolate the foam layer there between from the ambient environment, any reduction in pressure within the space between the foam layers and the outer layer will not affect the sterility of the inner surface of the inner layer.

In addition to the use of the collapsible hot/cold thermal insulated shipping and storage bags for foodstuffs, such as frozen foods or hot prepared food dishes, the bags are also ideal for other uses including transporting of medical items including medicine, blood, samples and organs, and other products that must be retained within tightly controlled temperatures.

In an alternative arrangement, the liner of the present invention is in the form of a substantially flat foldable liner including an insulating layer housed within a flexible sealed sack. The foldable liner is configured to be stored in a flat unfolded configuration or utilized in a folded configuration in which a substantially rectangular liner box is formed, which may be inserted into a cardboard shipping box or the like in order to transport or store goods.

The thermal insulated shipping and storage liners of the present invention are capable of maintaining perishable items at their optimal temperatures for extended periods of time. By way of example, the process of keeping items cold while moving them from one area to another is known as cold chain. A cold chain is further defined as an uninterrupted series of storage and distribution activities that are used to maintain the temperature of an item in a given range. The insulated shipping and storage liners of the invention allow items to be left with the end-consumers where the items can be safely maintained at their optimal temperatures, either hot or cold, for three or more hours.

In addition, the insulated shipping and storage liners of the invention are designed to be both light-weight and flexible thereby allowing the liners to be compressed, folded and compactly placed in shipping containers without consuming space that may be used for shipping other items and thereby aiding in reduction of both shipping and storage costs.

A further advantage of the insulated shipping and storage liners of the invention is that the open celled foam intermediate layer also function to cushion the contents of the liners, especially during transit and thus damage to the contents of the liners is less likely than with other prior art shipping containers.

Additional objects, features and advantages of the present invention will become more readily apparent from the following detailed description of preferred embodiments when taken in conjunction with the drawings wherein like reference numerals refer to corresponding parts in the several views.

BRIEF DESCRIPTION OF THE DRAWINGS

A better understanding of the invention will be had with reference to the accompanying drawings wherein.

DETAILED DESCRIPTION OF THE PREFERRED EMBODIMENTS

Figure 1:
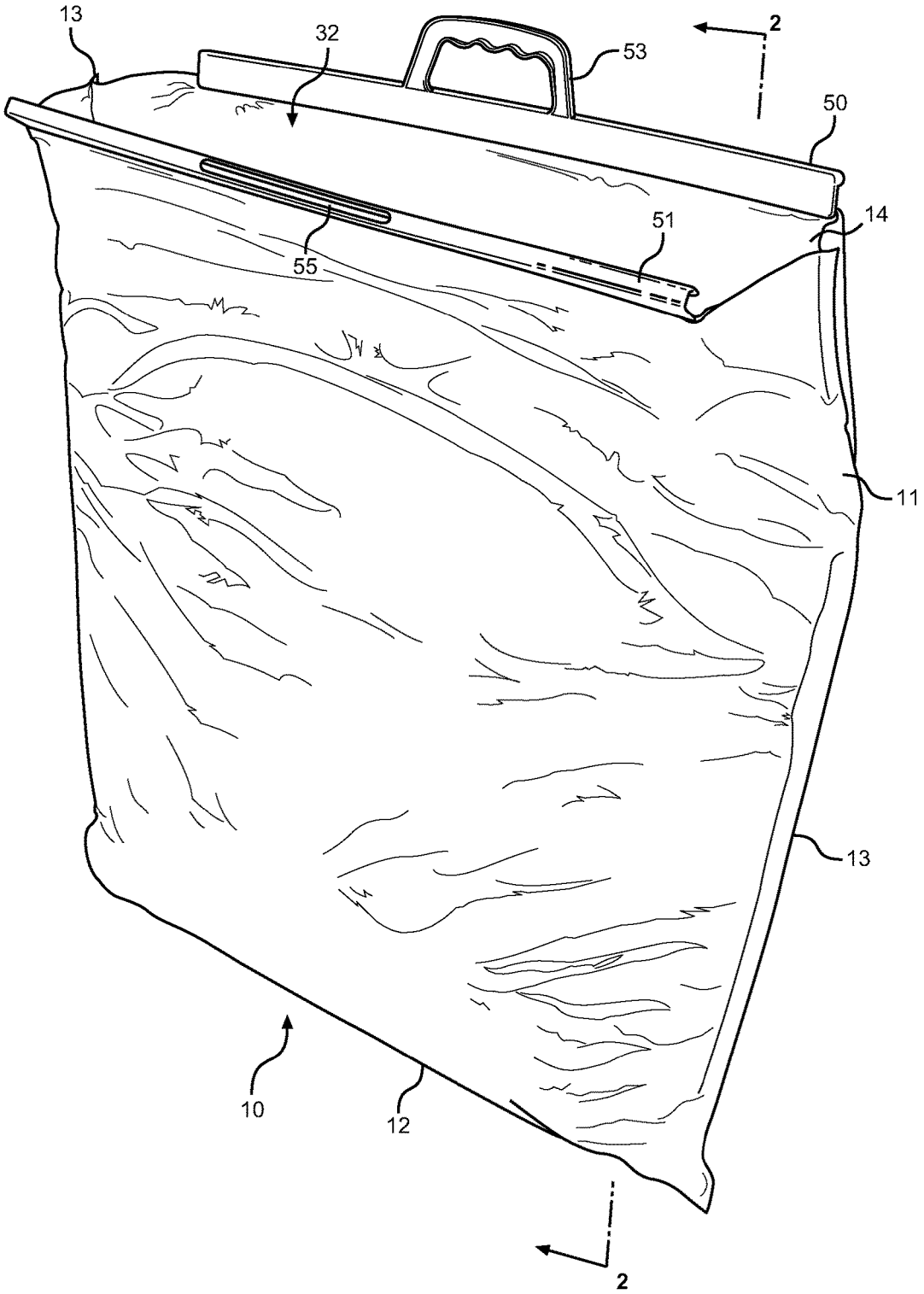
FIG. 1 is a top front perspective view of a shipping liner of the present invention in the form of a thermally insulated bag shown in an open position to receive an article or item therein.

With continued reference to the drawings, the invention will be described with respect to several embodiments for insulated and flexible or pliable hot/cold storage and shipping liners. In a first embodiment shown in FIGS. 1-4, a thermally insulated shipping liner of the present invention is in the form of an insulated bag 10. The insulated bag 10 is a multi-layer structure for storing and shipping temperature sensitive items that is made of at least three layers of thermal insulating materials. An outer layer 11 is preferably made of one or more materials that are known for reflecting radiant heat, are tear resistant, non-porous, leak proof, can be heat sealed or otherwise welded or sealed with a sterile poly pouch material, and that are compatible with conventional printing techniques. Such materials include, but are not limited to, thermoplastic polymers, such as metallic polyethylene terephthalate (METPET), and various reflective or metallic foils. Outer layer 11 can be printed with advertising information or any other indicia as desired.

Outer layer 11 is formed from a one-piece rectangular film that is folded along a midline thereof to create a pouch or bag shape having a bottom portion 12, with the side edges thereof being welded, heat sealed or otherwise sealed to form opposite side seams 13, thereby creating an opening 14 defined by outer layer 11.

Figure 2:
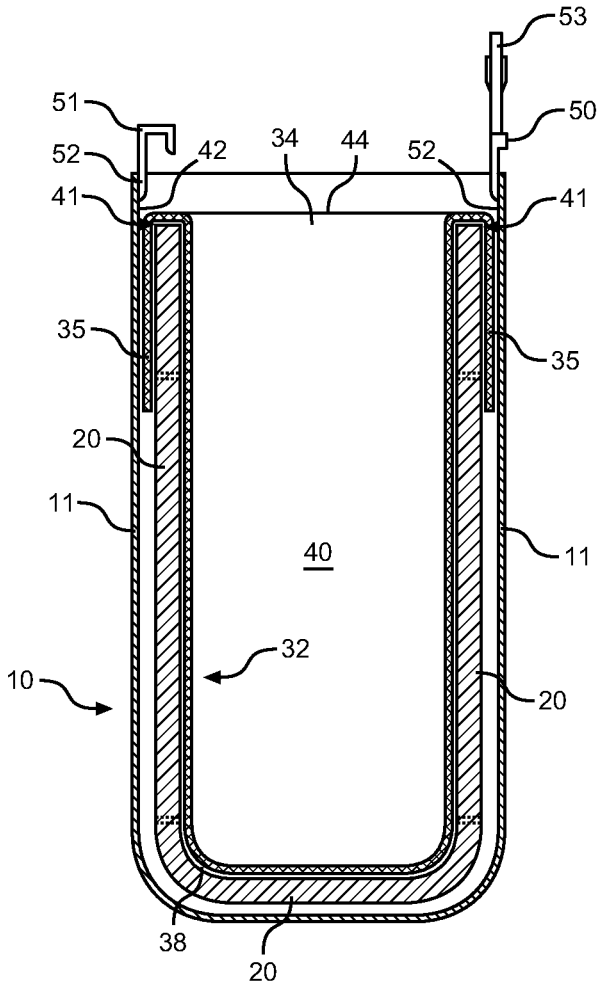
FIG. 2 is a cross section taken along line 2-2 of FIG. 1 showing the insulating layers of the insulated bag.
Figure 2A:
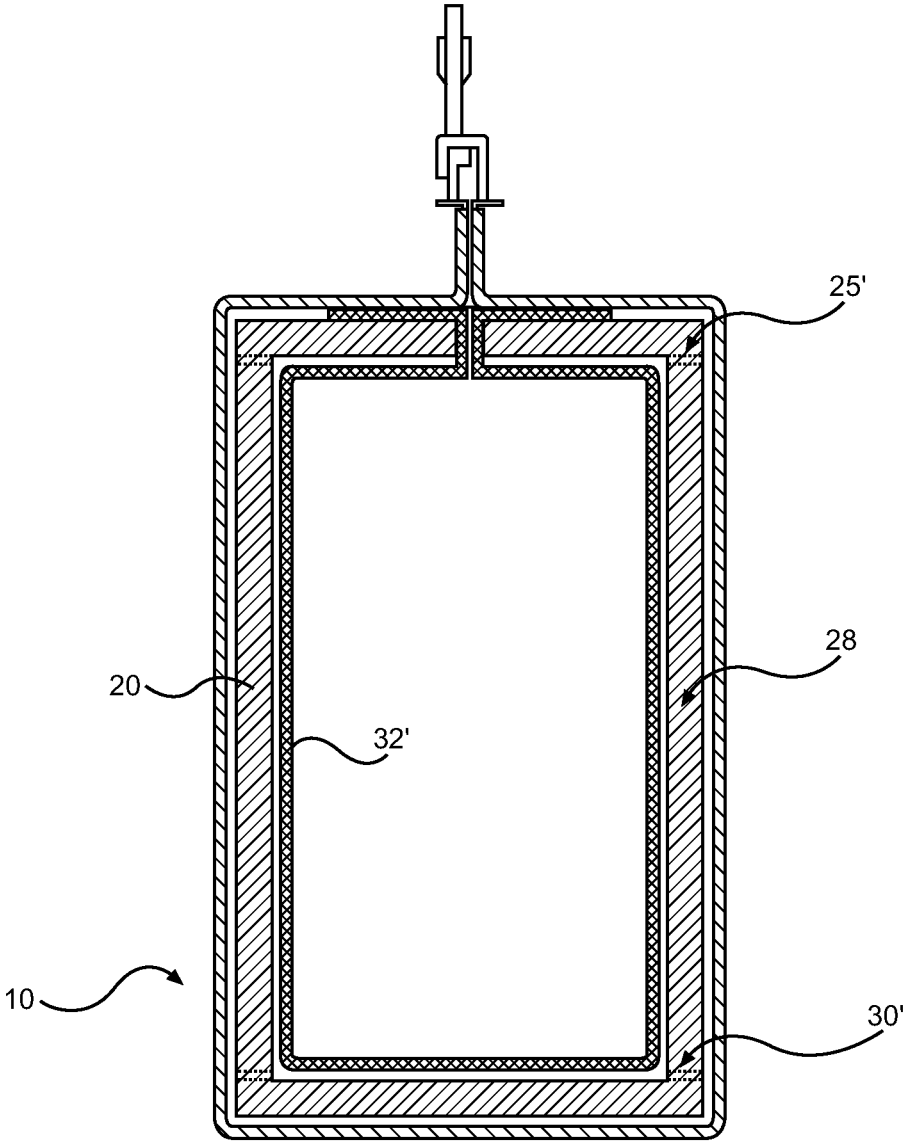
FIG. 2A is the cross section view of FIG. 2 showing the insulated bag in a free standing configuration.

An intermediate insulating layer 20, see FIG. 2, is preferably constructed of materials known for having low thermal transfers. Such materials include but are not limited to low density collapsible or compressible open cell polyurethane foams, including those foams that exhibit memory to reshape themselves after being deformed. The foam can be die-cast (molded) or cut and shaped to prevent any thermal bridges.

Thermal bridges are created when poorly insulated materials, or gaps present in the materials, allow heat transfer to occur through the material. To prevent thermal bridges, the insulated foam material(s) of insulating layer 20 is designed and placed to properly insulate the area of concern in which an item to be contained within insulated bag 10 is to be received. In view of this, the insulating foam layer 20 is preferably made from a polyurethane or polyurethane-like foam to prevent thermal bridges and to effectively maintain the low thermal transfer needed to assure that any perishable product is maintained at optimal temperatures. In addition to the low thermal properties of the foam, the foam is able to conform to any item enclosed within insulating bag 10, and to thereby become the frame and/or structure of the item. The self-forming foam creates a base or floor, lid and walls for a product when the product is placed therein. The foam also provides a protective cushion for any articles placed within insulating bag 10 and thus protects against article damage.

Figure 3:
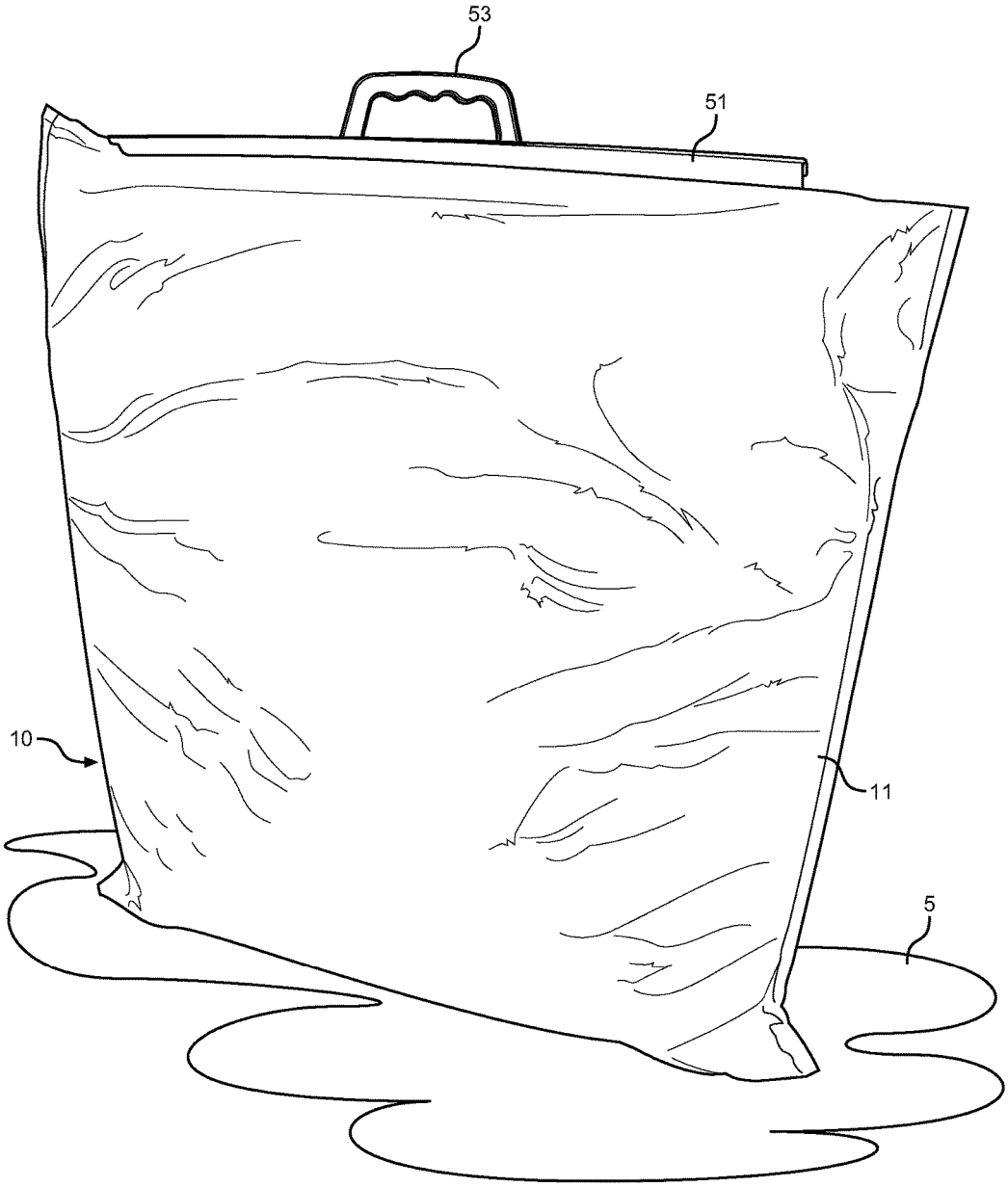
FIG. 3 is a top front perspective view of the embodiment of FIG. 1 with an article placed therein and showing how the insulated bag is self-standing on a support surface.
Figure 4:
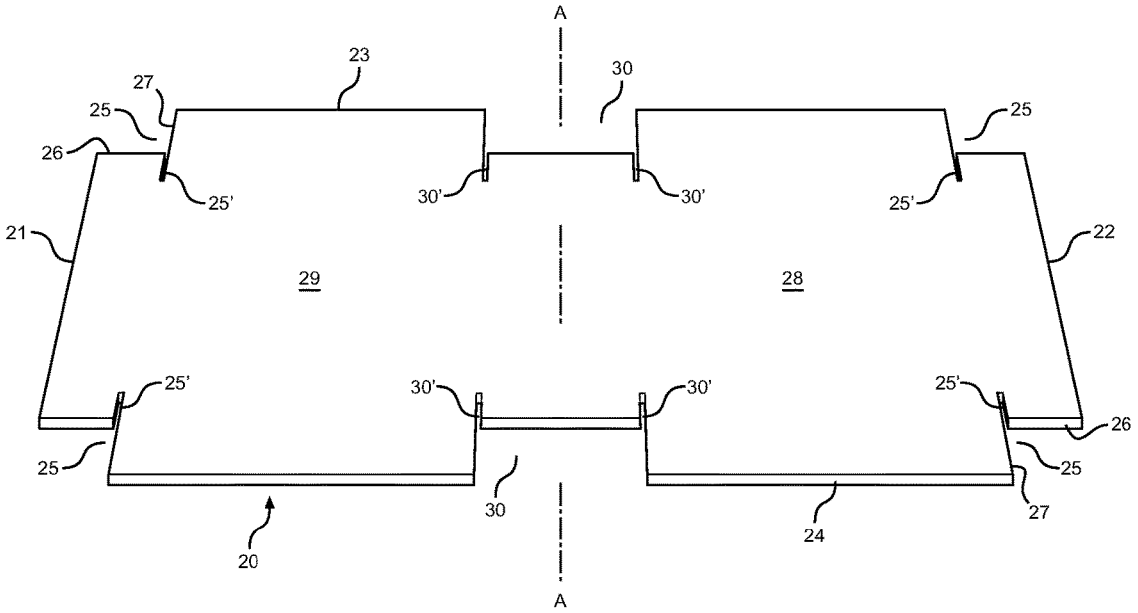
FIG. 4 is a top plan view of the intermediate foam layer showing cut outs with slits therein to facilitate the free standing nature of the insulated bag when is use.
Figure 4A:
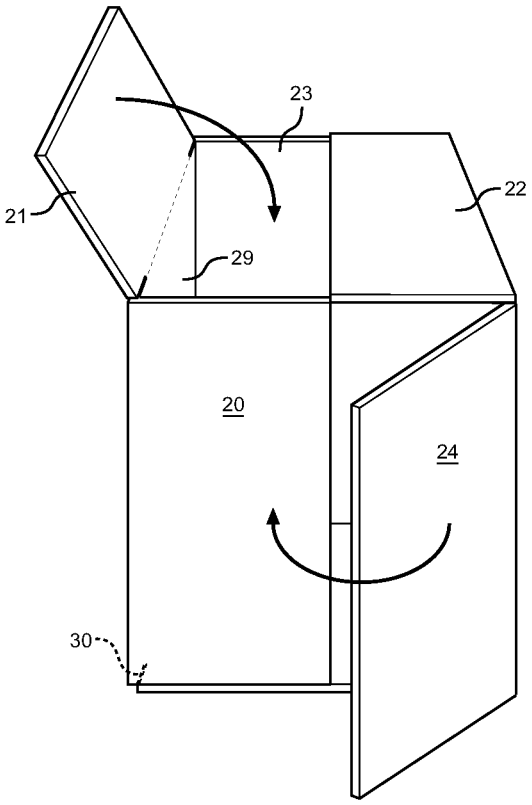
FIG. 4A is the top plan view of FIG. 4 showing the intermediate foam layer in a folded configuration to enable the free standing nature of the insulated bag.
Figure 5:
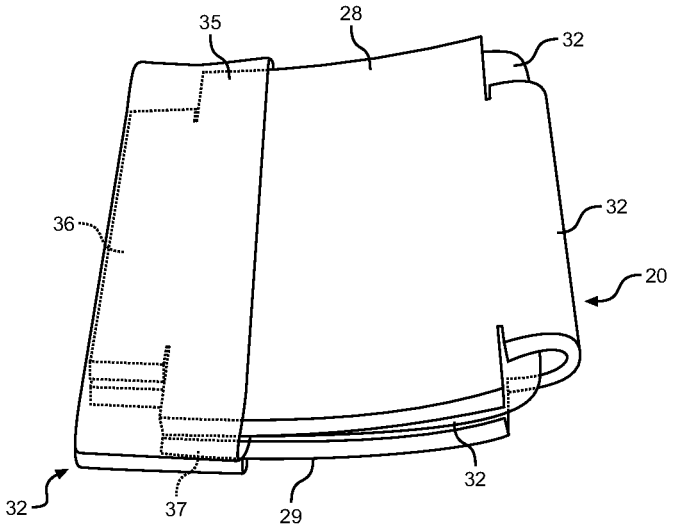
FIG. 5 is a perspective view of the inner plastic layer of FIG. 1 formed into a pouch-like structure and showing a cuff thereof frictionally engaging the upper ends of the intermediate foam insulating material therein.

With reference to FIG. 4, insulating layer 20 may be between approximately one half (1.5) inch to one and one half (1½) inches in thickness and may range in density. The foam layer is preferably in the form of a sheet that is generally rectangular in shape with two ends or top flaps 21 and 22 being substantially parallel to each other and two long sides 23 and 24 being substantially parallel to each other. The shape of insulating layer 20 is defined in part by generally rectangular cutout regions 25 in each corner. Each cutout 25 is defined by two intersecting wall portions 26 and 27 that intersect generally perpendicularly with one another. Cutout regions 25 may include an additional slit 25' extending into the width of the material to facilitate bending. With reference to FIG. 5, the size of cutouts 25 may vary depending upon the size of insulated bag 10, with the function of cutouts 25 to permit the top of the completed insulated bag 10 to fold at the corners thereof when insulating layer 20 is folded centrally at A-A to create opposing side walls 28 and 29. In addition to the corner cutouts 25, opposing cutouts 30 are provided centrally of the sides of insulating layer 20. Cutouts 30 are rectilinear and their size may also vary, with cutouts 30 functioning to facilitate the folding of bottom 12 of a complete insulated bag 10 to form a generally flat support base for the bag when an item is placed therein and the bag is placed on a support surface "S", as is shown in FIG. 3. As with cutout regions 25, cutout regions 30 may include additional slits 30' extending into the width of the material to facilitate bending.

It should be understood that the size of cutouts 25 and 30 relative to the dimensions of insulating layer 20 determines the size of insulating bag 10. Thus, insulating bag 10 can be configured for any desired size of shipping container or box.

Insulated bag 10 also includes an innermost layer 32 that is preferably made of one or more materials known for lower thermal convection. Such materials include polyurethanes, polypropylenes, elastomeric compounds and like materials that are leak-proof, non-porous and food grade, and that can be heat sealed or otherwise secured or welded to outer layer 11.

In a first embodiment of the invention, inner layer 32 is formed as a bag or pouch that is only open at a top opening 34 thereof, as is shown in FIG. 2. The pouch is provided with an annular outwardly folded cuff 35 at the opening therein such that cuff 35 is of a size to frictionally receive and retain upper free end portions 36 and 37 of the opposing side walls 28 and 29 of intermediate insulated layer 20. In this manner, intermediate insulating layer 20 is mechanically secured to inner layer 32 such that both layers may be simultaneously inserted within outer layer 11. This frictional retention of intermediate layer 20 within cuff 35 of inner layer 32 will also function to retain intermediate insulating layer 20 in place within outer layer 11 when the composite insulating bags 10 of the invention are in use and will also substantially seal the inner volume 40 of insulated bag 10 from the volume or area 38 between inner layer 32 and outer layer 11 to prevent contamination of inner volume 40. In some instances an adhesive or other agent may be used to completely or hermetically seal the upper portions 36 and 37 of intermediate foam material 20 within cuff 35 of inner layer 32.

In some embodiments and as shown in FIG. 2, the upper end of the inner plastic pouch layer 32 is welded at 41 to an inner surface 42 of outer layer 11, at or spaced slightly below the upper edges of outer layer 11 to hermetically enclose insulated bag 10 between inner layer 32 and outer layer 11.

Although not shown in the drawings, in some embodiments, the inner pouch-like structure of inner layer 32 may be heat sealed at an upper open end 44 after articles or items are placed within insulated bag 10. In other embodiments, mechanical zip-like closures or double sided tapes may be used to seal upper end 44 of inner bag 32 after articles or items are placed therein. In yet other embodiments, the inner bag 32 may not be sealed at opening 34.

Preferably, the upper ends of the outer layers 11 are provided with either heat seals or mechanical zip-like locks or friction lock seals. In some embodiments, the seals may be created using friction lock members 50 and 51 that are initially sealed at 52 to the upper edges of the opposing sides of outer layer 11. Friction lock member 50 includes a handle 53 that is insertable through a handle 53 in the lock member 51. Lock member 51 is generally u-shaped in cross section, see FIG. 2, with a width of the cross section being such that lock member 50 is frictionally seated therein to seal the members together when handle 53 is inserted through an opening 55 to thereby seal insulated bag 10. See FIG. 3.

Insulated bag 10 can be closed using other known conventional methods such as pressure closures, taping closures, flaps with re-sealable taping means, flaps with peel-off taping means, plastic zip-lock fasteners and the like.

Although not shown in the figures, in some embodiments one or more addition foam layers may be inserted between the inner pouch or layer 32 and outer layer 11 to increase the insulating properties of insulated bag 10, thus increasing the length of time products will remain at optimal temperatures within insulated bag 10.

Figure 8:
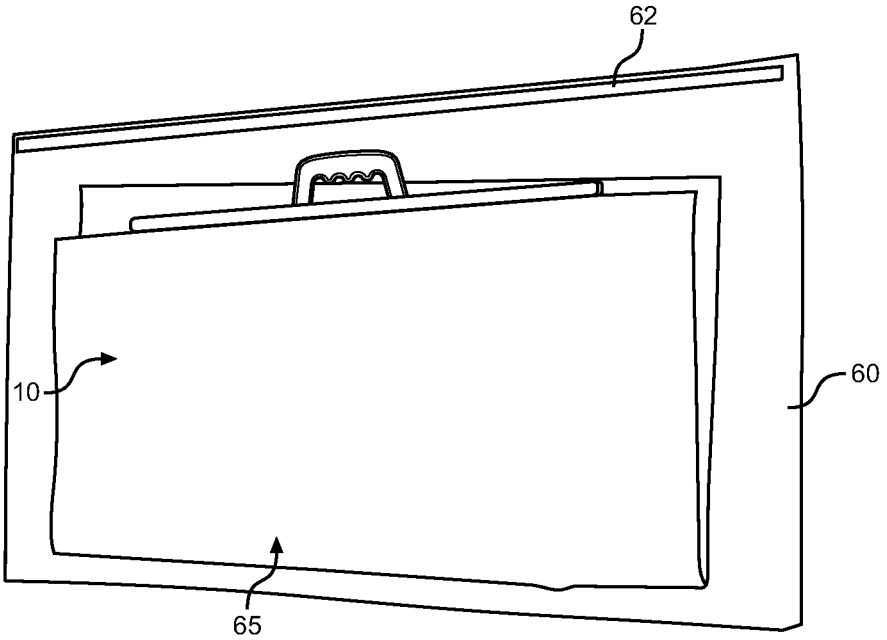
FIG. 8 is a side view of a plurality of insulated bags in accordance with the invention being placed within an outer plastic sealable enclosure for shipment to an end user while compactly retained or folded under internal reduced pressure.

As noted above, insulated bag 10 can be utilized on its own for shipping and storing goods. Alternatively, insulated bag 10 can be utilized as a liner within an outer container, such as a cardboard box or the like. As previously described, one of the advantages of the present invention is that insulated bags 10 may be compactly arranged and retained either for storage or shipment to wholesalers or end users to thereby reduce shipping package volumes and thus reduce costs associated with shipping and storage of insulating bags 10. With reference to FIG. 8, a first embodiment for reducing the volume of insulated bags 10 of the invention is shown in detail. As shown, one or more insulated bags 10 may be placed within an outer bag 60, such as a plastic bag or the like, having one end with a sealable opening 62. Thereafter, outer bag 60 is mechanically collapsed, as reflected by the arrow 65, to force most air out of the enclosed insulated bags 10 and outer bag 60. Thereafter, outer bag 60 is sealed. In some embodiments, a partial vacuum may be applied within outer bag 60 to reduce the pressure therein and to reduce the volume of the overall package (insulated bag 10 and outer bag 60), and outer bag 60 is subsequently sealed.

Figure 6:
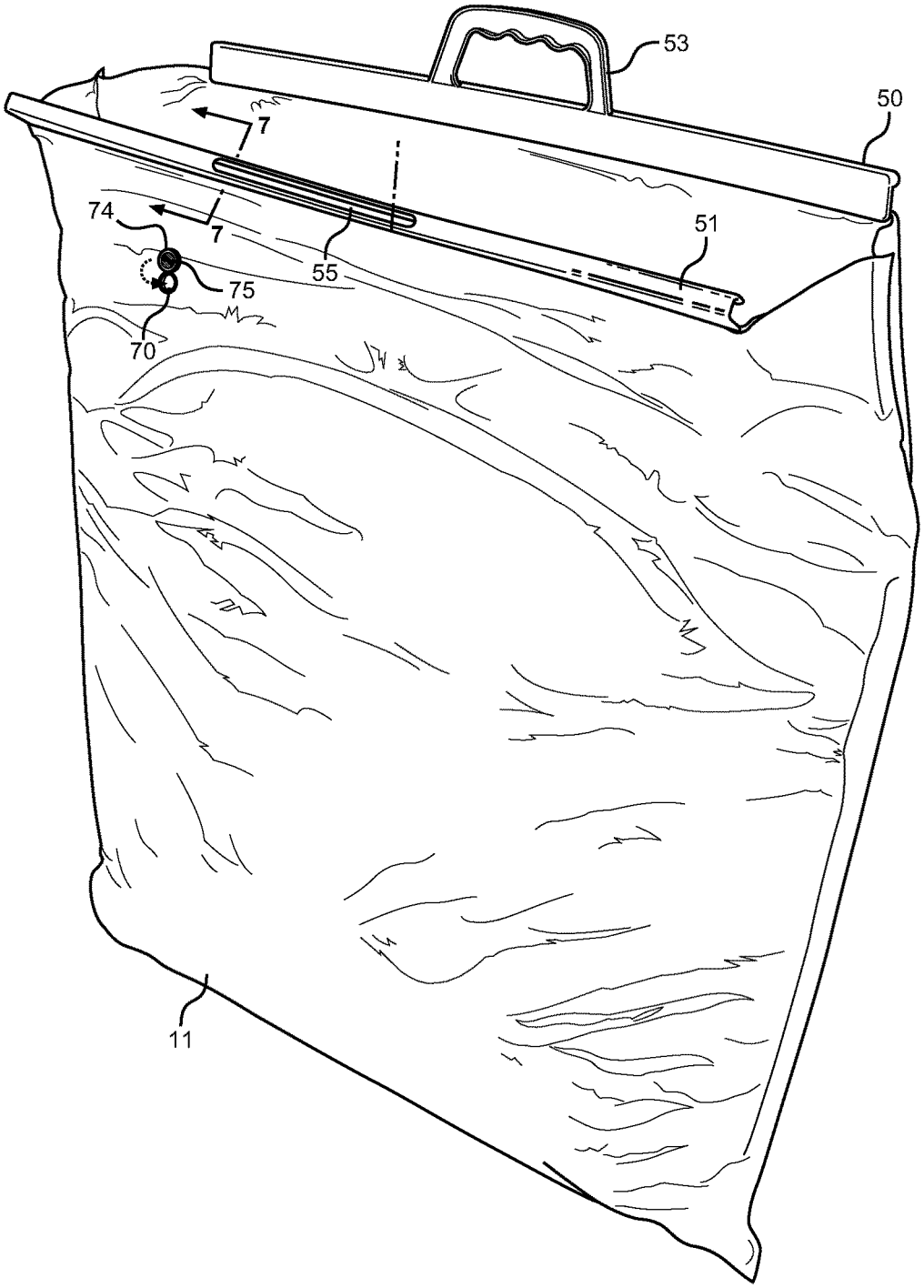
FIG. 6 is a view similar to FIG. 1 showing one of the insulated bags of the invention with an opening and related closure for use in evacuating and subsequently inflating the bag to permit compact storage and shipment to an end user.
Figure 7:
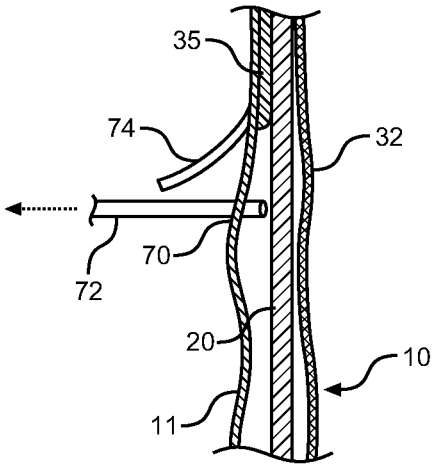
FIG. 7 is a cross section taken along line 7-7 of FIG. 6 showing a tube placed through the opening for reducing the pressure within bag and the open cell foam therein.

Another embodiment of the invention depicted in FIGS. 6 and 7 facilitates the compact handling and/or folding of the multi-layered insulated bags 10 of the invention for storage or shipment to wholesalers or end users for subsequent use. The interior of bags 10, and especially intermediate insulating layers 20 comprised of open cell foam, are designed to enable air to be evacuated there from by the application of a partial vacuum. Such a vacuum may be applied to bag 10 through opening 70 between outer layer 11 and intermediate insulating layers 20 using a vacuum tube 72, or by placing bag 10 within an enclosure under a reduced atmosphere. When vacuum tube 72 is withdrawn, or the predetermined reduced pressure is obtained within bag 10, outer opening 70 is closed by removable adhesive patch or cover 74 to prevent ambient air from entering bag 10. Cover or patch 74 includes a self stick adhesive 75 on an inner face thereof for use in sealing opening 70 to prevent inadvertent inflation of the space within bag 10. When bag 10 has been at least partially evacuated so that air is removed from the open cell foam of insulating layer 20 and from between outer layer 11 and inner layer or pouch 32, they are easily stacked or folded into compact configurations for storage or for shipment. When bag 10 is to be used by an end user, patch or cover 74 is removed and bag 10 will automatically expand as ambient air enters opening 70 therein. After bag 10 is inflated, adhesive patch or cover 74 may be reapplied to prevent contaminants from entering opening 70 therein. In this regard, when insulated shipping and storage bags 10 are to be used to ship or store items that must remain sterile, the vacuum processes and inflating processes may take place within sterile enclosures.

Figure 9:
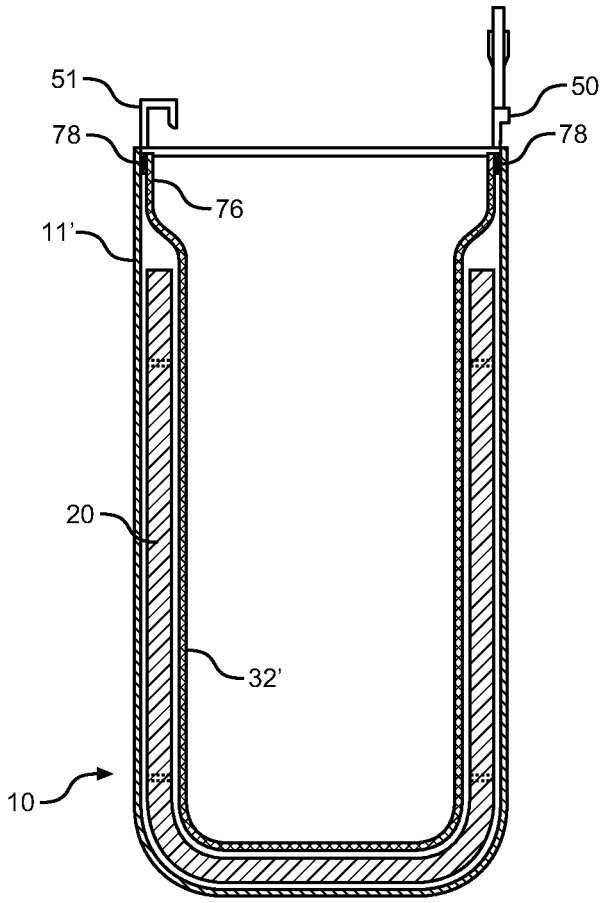
FIG. 9 is a cross sectional view similar to FIG. 2 showing an alternate embodiment of the insulated bag.
Figure 9A:
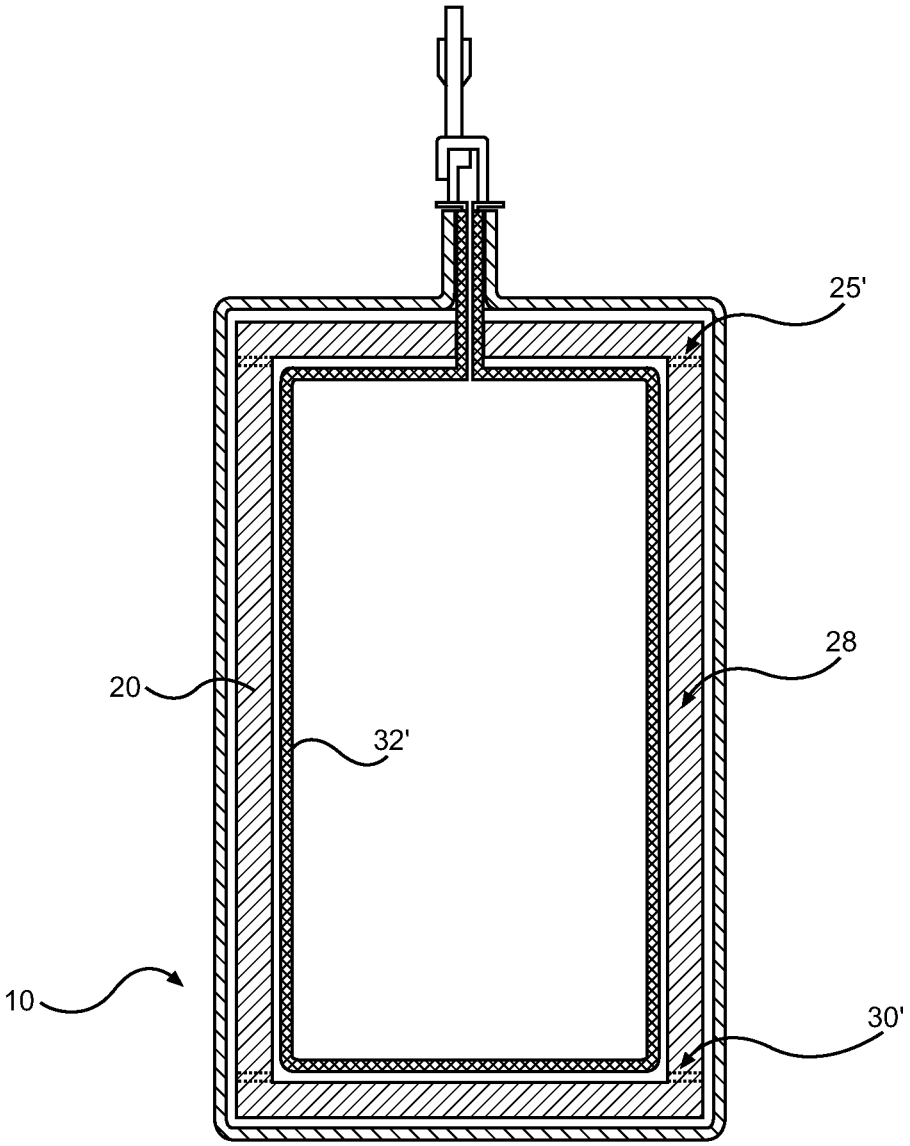
FIG. 9A is a cross section view of the alternate embodiment of the insulated bag in a free standing configuration.

With reference to FIG. 9, another embodiment or insulated bag 10' of the invention is disclosed wherein cuff 35 of inner layer or pouch 32' associated with the embodiment shown in FIGS. 1 and 2 is not used. In this embodiment, inner layer or pouch 32' includes an upper free edge 76 that is directly sealed or welded at 78 to an inner surface of outer reflective layer 11' below the opening into bag 10'. Bag 10' of this embodiment may be used with vacuum opening 70 and seals 74 previously described, and the materials and the manner of compact shipment or storage including the use of an outer packaging container or pouch 60 may also be the same.

Figure 10:
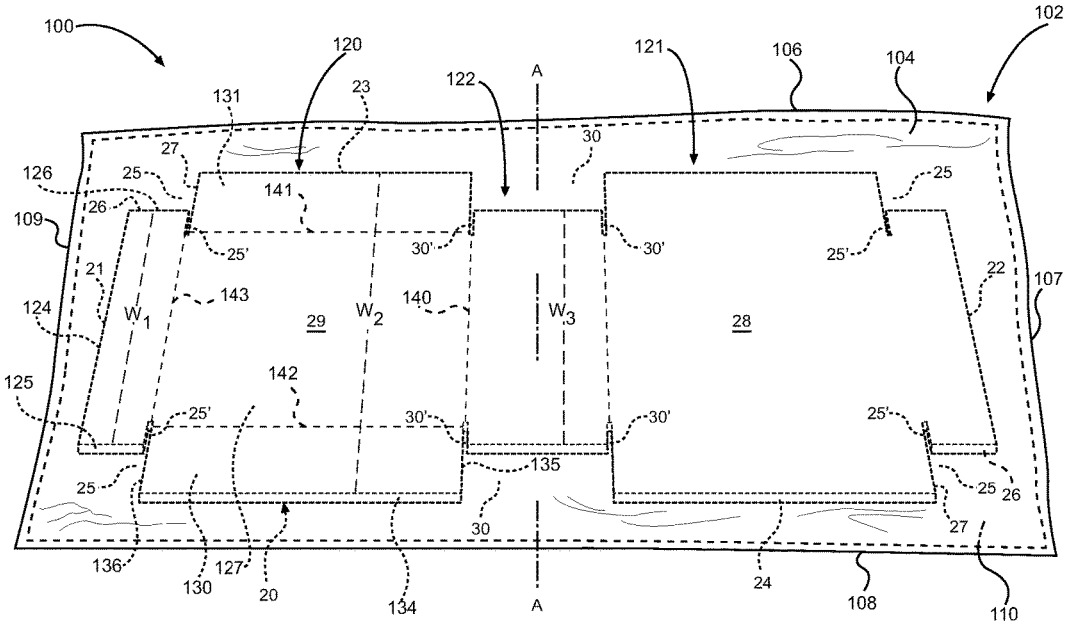
FIG. 10 is a top perspective view of a shipping liner of the present invention in the form of a planar foldable thermal liner.
Figure 11:
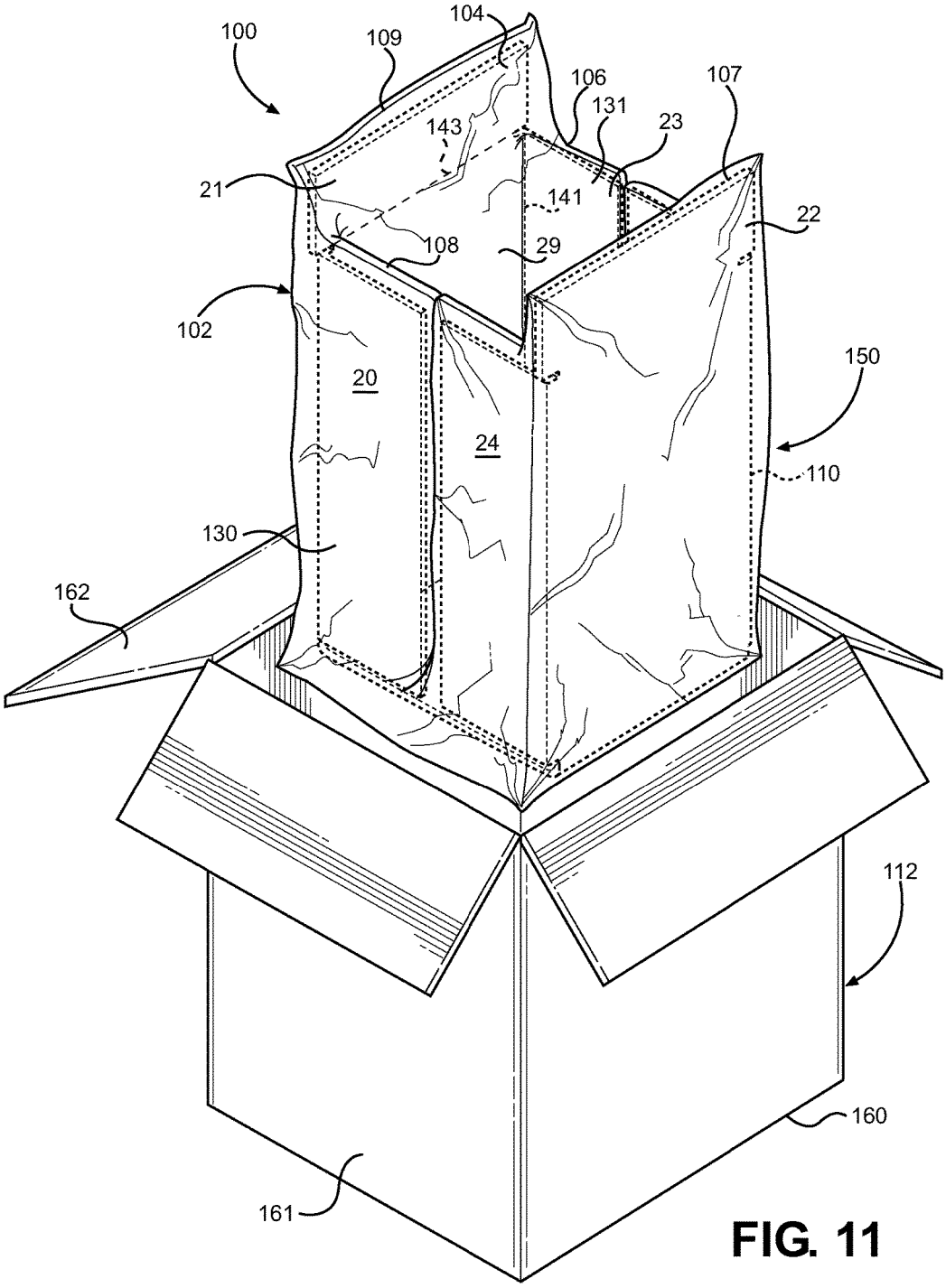
FIG. 11 is a perspective view of the thermal liner of FIG. 10 in a folded configuration for insertion into a shipping container.

In an alternative arrangement depicted in FIG. 10, the insulated shipping liner of the present invention is in the form of a substantially planar or flat foldable liner 100, including an intermediate or inner insulating layer 20 housed within a flexible sealed sack 102. Cutouts such as 25 and 30 are utilized to transform a single piece of foam material into a box template, or insulating layer 20. Sack 102 comprises a first or upper layer 104 sealed about peripheral edges 106-109 to a second or lower layer 110. The term flat should be understood to mean that foldable liner 100 includes substantially coplanar spaced upper and lower layers 104, 110 when in a non-folded state. In the first flat liner embodiment shown, inner insulating layer 20 is the same as the one utilized in the insulated bag embodiment of FIGS. 1-4. Additionally, upper layer 104 and lower layer 110 may be comprised of the same materials as innermost layer 32 or outer layer 11. In one example, upper layer 104 and lower layer 110 are both comprised of impermeable thin plastic material. In another example, upper layer 104 is comprised of a non-porous plastic material and lower layer 110 is comprised of a radiant energy reflecting material. However, unlike the embodiment of FIGS. 1-4, the layers 104, 110 of flat foldable liner 100 are not welded or otherwise secured together to form a pouch or container. Instead, flat foldable liner 100 is configured to be stored in a flat unfolded configuration depicted in FIG. 10, or utilized in a folded configuration within a rectangular shipping container, such as a cardboard box 112 depicted in FIG. 11. In order to more fully describe the manner in which flat foldable liner 100 can be utilized, additional details of insulating layer 20 will now be discussed with reference to FIG. 10.

Insulating layer 20 includes a first side portion 120, a second side portion 121, and a middle portion 122 between the first and second side portions 120,121. In the first embodiment shown, the first and second side portions 120 and 121 are mirror images of one another. For simplicities sake, only the first side portion 120 will be discussed in detail, with the understanding that second side portion 121 will have like details. First side portion 120 includes a substantially rectangular shaped top flap 21 having and end wall 124 and opposing side walls 125,126 extending from a panel 127, wherein a width $W_1$ of insulating layer 20 at top flap 21 is less than a width $W_2$ of insulating layer 20 at panel 127, and a width $W_3$ of insulating layer 20 at middle portion 122 is less than width $W_2$ of insulating layer 20 at panel 127, such that substantially rectangular opposing side flaps 130, 131 are defined on panel 127. Each opposing side flap 130,131 includes an end wall 134 and opposing side walls 135,136.

In use, the box template or insulating layer 20 is bendable along a first lateral fold line indicated at 140 between first side portion 120 and middle portion 122; first and second longitudinal fold lines 141, 142 between respective substantially rectangular flaps 130, 131 and panel 127; and a second lateral fold line 143 between first top flap 21 and panel 127. It should be understood that corresponding fold lines exist for second side portion 121, which is a mirror image of first side portion 120. Preferably, insulating layer 20 is constructed from a continuous sheet of insulating foam material, without any perforations or the like marring the surface of the insulating layer 20. With this configuration, insulating layer 20 can be folded by a user along fold lines 140-143 of first side portion 120 and corresponding fold lines of second side portion 121 to transition liner 100 from a substantially flat storage position shown in FIG. 10 to a three-dimensional box form depicted in FIG. 11. More specifically, first and second side portions 120, 121 define opposing sides of a three-dimensional substantially rectangular box form 150, middle portion 122 defines a bottom of box form 150, and opposing substantially rectangular first and second side flaps 130, 131 defining at least part of other opposing sides of box form 150. Advantageously, fold lines 140-143 are continuous with first and second portions 120, 121 and middle portion 122 such that thermal protection is not compromised along fold lines 140-143. At this point it is also noted that flexible sealed sack 102 is preferably rectangular in form, and extends beyond the outer peripheral ends of insulating layer 20. Although housed within flexible sealed sack 102, in one embodiment, insulating layer 20 is otherwise unattached to flexible sealed sack 102. This configuration provides for ease in manufacturing liner 100.

Figure 12:
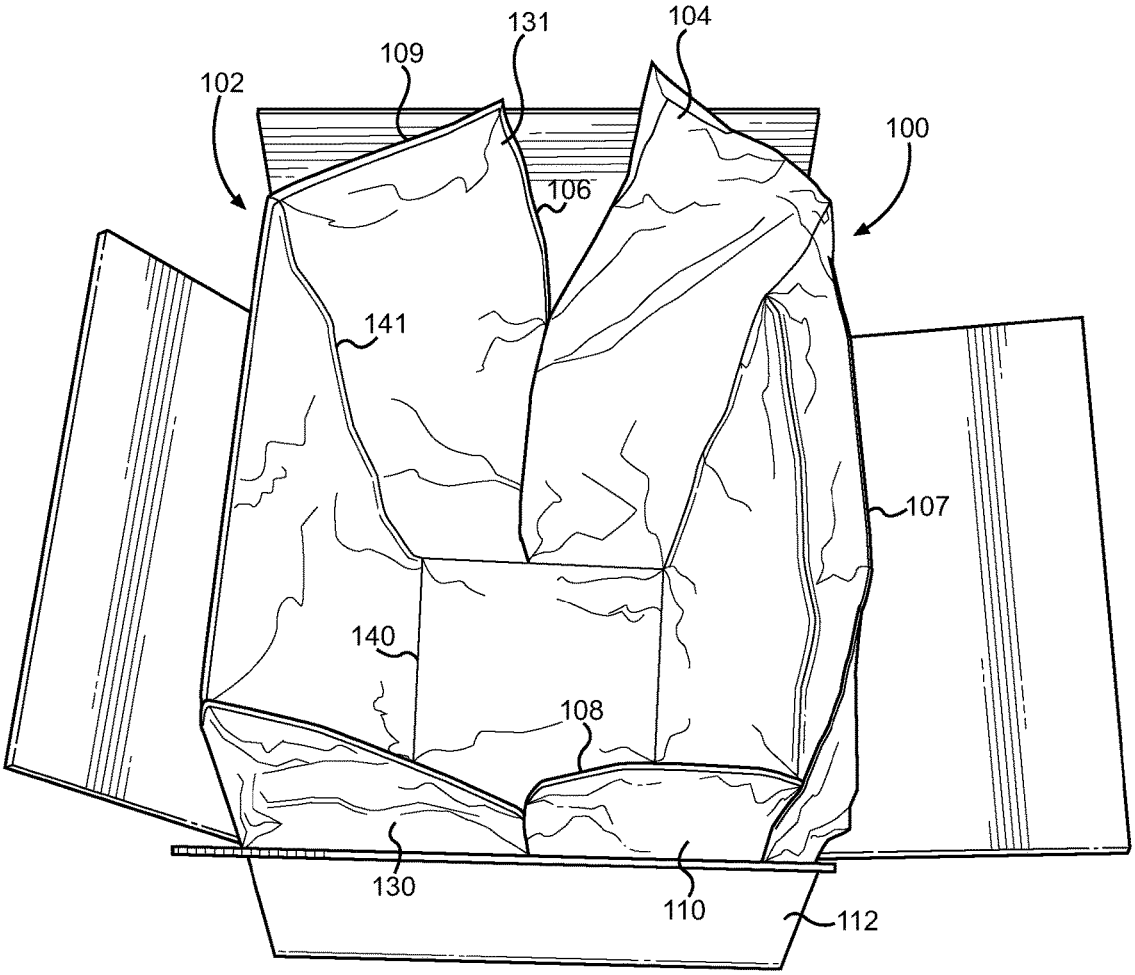
FIG. 12 is a top perspective view of the shipping container of FIG. 11 with the thermal liner fit therein.

Once a user positions box form 150 within a container, such as box 112, the flexible nature of liner 100 enables liner 100 to conform to the inner dimensions of box 112, as depicted in FIG. 12. That is, the bottom of liner 100 extends along a bottom 160 of box 112, the four sides of liner 100 extend along corresponding sides 161 of box 112. A user may then insert goods into the lined box 112 and close liner 100 and box 112 for shipping or storage. More specifically, end flaps 21, 22 can be folded along respective lateral fold lines 143 such that end flaps 21, 22 form a top of box form 150. When the container defined by liner 100 and box 112 is in its closed position, it should be understood that the top of liner 100 extends beneath a top of box 112 comprised of flaps 162. In the preferred embodiment, the resilient nature of the foam material used for insulating layer 20 provides cushioning and insulation for items within box form 150. It is noted that sack 102 is preferably constructed of thin, flexible material such that sack 102 does not interfere with the folding of insulating layer 20, and portions of sack 102 which extend beyond the peripheral edges of insulating layer 20 can simply be tucked into the free space within box 112 when liner 100 is in its folded position.

Figure 13:
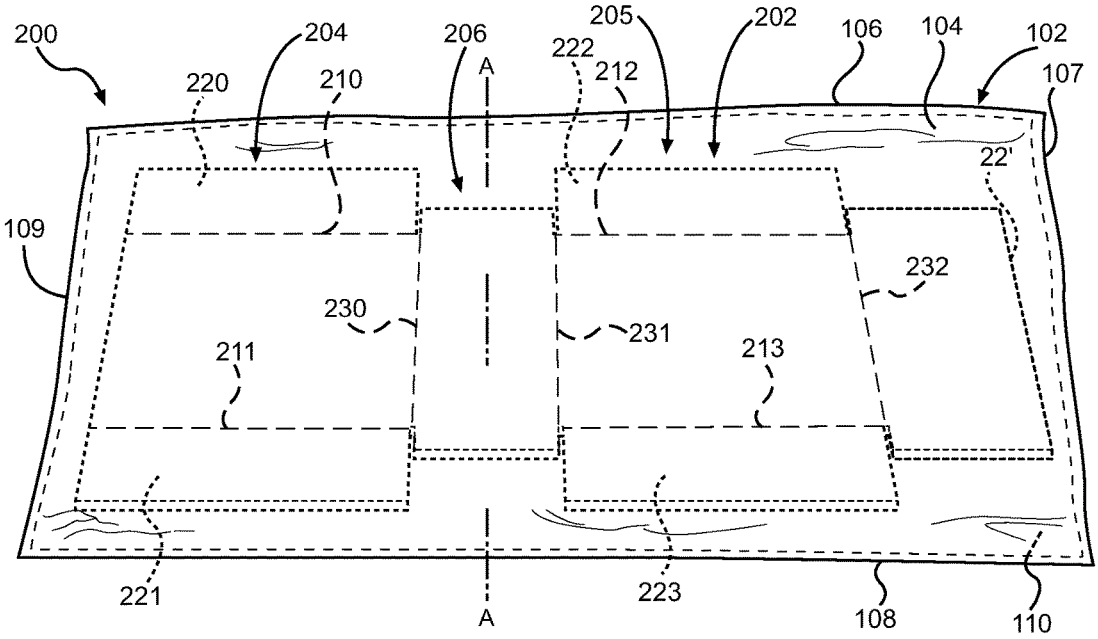
FIG. 13 is a top perspective view of a first alternative planar foldable thermal liner of the present invention.

Insulating layer 20 can take on a variety of different configurations, each of which can be folded to form a three-dimensional substantially rectangular box form. For example, an alternative foldable liner 200 depicted in FIG. 13 comprises a flexible sealed sack 102 and an insulating layer 202 with nearly the same configuration as insulating layer 20, with the exception that a first side portion 204 does not include a top flap 21, and a second side portion 205 includes a large top flap 22' configured to form the entire top of a liner box when liner 200 is in a folded position. Similar to liner 100, insulating layer 202 includes a middle portion 206 between the first and second side portions 204 and 205, with longitudinal fold lines 210-213 defining respective opposing sets of side flaps 220-223, lateral fold lines 230-231 provided between middle portion 206 and respective first and second side portions 204 and 205, and a lateral fold line 232 provided between a panel 240 of second side portion 205 and large top flap 22'. Liner 200 is configured to be folded along fold lines 210-213 and 230-232 to form a three dimensional generally rectangular box form (not shown).

Figure 14:
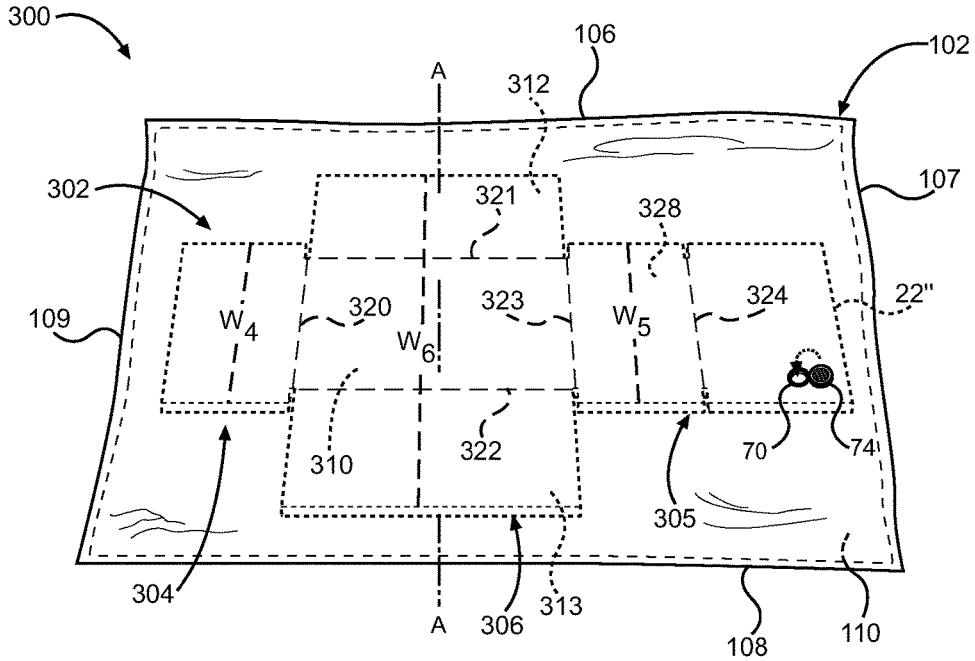
FIG. 14 is a top perspective view of a second alternative planar foldable thermal liner of the present invention.

In another alternative embodiment shown in FIG. 14, a liner 300 includes an insulating layer 302 having a first side portion 304 with a width $W_4$, a second side portion 305 with a width $W_5$ substantially the same as $W_4$, and a middle portion 306 separating the first and second side portions 304,305, and having a width $W_6$ greater than $W_4$ and $W_5$. With this configuration, a panel 310 of middle portion 306 has opposing side flaps 312 and 313 extending there from. In use, insulating layer 302 is folded along a first lateral fold line 320 between first side portion 304 and middle portion 306; first and second longitudinal fold lines 322, 322 between respective substantially rectangular flaps 312 and 313 and panel 310; a second lateral fold line 323 between second side portion 305 and middle portion 306; and a third lateral fold line 324 between a top flap 22" and a panel 328 of second end portion 305. With this configuration, insulating layer 302 can be folded by a user along fold lines 320-324 from the substantially flat storage position shown in FIG. 14 to a three-dimensional position. More specifically, top flap 22" becomes a top of a box form, panel 328 and first side portion 304 become opposing side walls of the box form, substantially rectangular flaps 312, 313 become other opposing side walls of the box form, and panel 310 becomes a bottom of the box form.

Any of the liners of the present invention can also include an opening 70 with a cover 74, as depicted in FIG. 14. As with the bag embodiment of FIGS. 1-4, air can be evacuated through opening 70 before closing off opening 70 with an air-tight cover 74. In this way, the size of a liner, e.g. liner 300, can be reduced for shipping and storing. In this embodiment, the insulating layer, e.g. 302, is comprised of an elastic material such as open celled foam, which can self inflate once cover 74 is removed from opening 70 and air is allowed back into liner 300.

Although described with reference to preferred embodiments of the invention, it should be readily understood that various changes and/or modifications can be made to the invention without departing from the spirit thereof. For instance, the embodiments of FIGS. 13 and 14 could be folded along lines A-A and the sides of sack 102 secured together to form a bag type liner similar to the embodiments of FIGS. 1-4. In general, the invention is only intended to be limited by the scope of the following claims.

We claim:

1. An insulated shipping and storage liner comprising:

pliable first and second layers that are sealed together so as to form a bag configuration having (i) a bottom, (ii) walls, (iii) an opening generally opposite the bottom, (iv) a first major outer liner surface, (v) a second major outer liner surface opposite said first major outer liner surface, (vi) a first major inner liner surface, (vii) a second major inner liner surface opposite said first major inner liner surface, said first major inner liner surface and said second major inner liner surface (a) being positioned between said first major outer liner surface and said second major outer liner surface, and (b) forming an article receiving pouch of said liner accessible via said opening, and (viii) a liner housing volume of a first size between said pliable first and second layers;

an insulating layer positioned within the housing volume and being of a size smaller than the first size and being movable relative to the pliable first and second layers, the insulating layer consisting of at least one sheet of insulating material having (a) a first insulating material end portion positioned along said opening and extending within a first space between (i) said first major outer liner surface and (ii) said first major inner liner surface and (b) a second insulating material end portion positioned along said opening and extending within a second space between (i) said second major outer liner surface and (ii) said second major inner liner surface, each of said first insulating material end portion and said second insulating material end portion consisting of rectilinear cut outs at opposite corners thereof along said opening; and a liner closure capable of at least partially closing said opening of said liner;

wherein the liner is configured to be convertible into a substantially rectangular box form having a bottom wall, two pair of opposing side walls and opposing top walls, each of which is foldable over upper edges of the two pair of opposing side walls whereby, when the liner is inserted into an open box outer shipping or storage container, the liner conforms to an interior configuration of the outer box shipping and storage container and thereby provides an insulated covering for all inner surfaces of the outer shipping or storage container, when inserted into the outer box shipping or storage container, including the bottom wall, opposite side walls and top wall of the outer box shipping or storage container when the top wall is closed.

2. The insulated shipping and storage liner of claim 1, wherein the pliable first and second layers comprise at least one of a non-porous plastic material and a radiant energy reflecting material.

3. The insulated shipping and storage liner of claim 1, wherein the insulating layer consists of an open cell foam material.

4. The insulated shipping and storage liner of claim 1, wherein said insulating layer further consists of opposing cut outs generally centrally along opposite side edges of said insulating layer so as to form a middle portion between two side portions, said opposing cut outs enabling a free standing configuration whereby said insulating layer is folded centrally thereof so that said middle portion becomes the bottom, and said side portions become the walls.

5. The insulated shipping and storage liner of claim 1, wherein the insulating layer is positioned within the housing volume but otherwise unattached to the pliable first and second layers.

6. An insulated shipping and storage container comprising:

an outer box shipping and storage container comprising at least a planar bottom wall, two sets of opposing planar side walls and at least one top panel; and an insulated shipping comprising:

a pliable sealed housing formed between first and second layers that are sealed together at peripheral edges thereof and being of a first size, said pliable sealed housing having a bag configuration with a liner bottom, liner walls, and a liner opening generally opposite the liner bottom;

an insulating layer positioned within the pliable sealed housing and being of a size smaller than the first size and being movable relative to the pliable sealed housing, the insulating layer consisting of at least one sheet of insulating material having (a) a first insulating material end portion positioned along said opening and extending within a first space between (i) said first major outer liner surface and (ii) said first major inner liner surface, (b) a second insulating material end portion positioned along said opening and extending within a second space between (i) said second major outer liner surface and (ii) said second major inner liner surface, each of said first insulating material end portion and said second insulating material end portion consisting of rectilinear cut outs at opposite corners thereof along said opening, and (c) opposing cut outs generally centrally along opposite side edges of said insulating layer so as to form a middle portion between two side portions, said opposing cut outs enabling a free standing configuration whereby said insulating layer is folded centrally thereof so that said middle portion becomes the bottom, and said side portions become the walls; and a liner closure capable of at least partially closing said liner opening of said liner;

wherein the insulated shipping liner is convertible into a substantially rectangular box form having a planar bottom wall, two pair of opposing planar side walls and two top walls, each of which is foldable over upper edges of the two pair of opposing side walls whereby, when the insulated shipping liner is inserted into the outer box shipping or storage container, the insulated shipping liner conforms to an interior configuration of the outer box shipping and storage container, when inserted into the outer box shipping or storage container, and thereby provides an insulated covering for all inner surfaces of the outer shipping or storage container including opposite planar side walls, planar bottom wall and top panel of the shipping or storage container when the at least one top panel is closed.

7. The insulated shipping and storage container of claim 6, wherein the pliable sealed housing is formed of at least one of a non-porous plastic material and a radiant energy reflecting material.

8. The insulated shipping and storage container of claim 6, wherein the insulating layer consists of an open cell foam material.

9. The insulated shipping and storage container of claim 6, wherein the insulating layer is positioned within the pliable sealed housing but otherwise unattached to the pliable sealed housing.

10. The insulated shipping and storage liner of claim 1, wherein said insulated shipping and storage liner consists of said pliable first and second layers, said insulating layer, and said liner closure.

11. The insulated shipping and storage liner of claim 10, wherein said liner closure consists of peel-off taping means.

12. The insulated shipping and storage liner of claim 11, wherein the insulating layer consists of an open cell foam material.

13. The insulated shipping and storage container of claim 6, wherein said insulated shipping and storage container consists of said outer box shipping and storage container, said pliable sealed housing consisting of said first and second layers, said insulating layer, and said liner closure.

14. An insulated shipping and storage container comprising:

an outer box shipping and storage container comprising at least a planar bottom wall, two sets of opposing planar side walls and at least one top panel; and an insulated shipping and storage liner having a bottom, walls, and an opening generally opposite the bottom, the liner consisting of:

an outer layer;

an intermediate insulating layer, said intermediate insulating layer consisting of at least one sheet of insulating material having a generally rectangular shape with cut outs at each of four corners of said generally rectangular shape and opposing cut outs generally centrally along opposite side edges of said generally rectangular shape so as to form (i) a middle portion between (ii) two side portions, and (iii) end portions opposite said middle portion, said cut outs enabling a free standing configuration whereby said intermediate insulating layer is folded centrally thereof so that said middle portion becomes the bottom, said side portions become the walls, and said end portions extend along opposing edges of said opening of the liner;

an inner plastic layer, said inner plastic layer being secured or welded to said outer layer of said liner with said end portions of said intermediate insulating layer extending along opposing edges of said opening; and a liner closure capable of at least partially closing said opening, said liner closure being selected from the group consisting of a mechanical zip-like closure, a double sided tape, a pressure closure, a taping closure, a flap with re-sealable taping means, and a flap with peel-off taping means.

15. The insulated shipping and storage container of claim 14, wherein said intermediate insulating layer consists of two or more sheets of foam material.

16. The insulated shipping and storage container of claim 14, wherein said outer layer consists of a generally rectangular shaped film that is folded over onto itself and welded along side edges so as to form (i) a bottom portion, (ii) opposite side edges, and (iii) an outer layer opening.

17. The insulated shipping and storage container of claim 14, wherein an upper end portion of said outer layer extends beyond said opening so as to form a flap, and said liner closure is positioned along said flap and consists of a peel-off taping means for taping close said liner.

18. The insulated shipping and storage container of claim 14, wherein said insulating material consists of foam material.

19. The insulated shipping and storage container of claim 14, wherein said insulating material further consists of (i) a first set of slits extending from said cut outs into a central portion of said insulating material and (ii) a second set of slits extending from said opposing cut outs into a central portion of said insulating material so as to facilitate bending of said insulating material.

20. The insulated shipping and storage container of claim 14, wherein said insulating material consists of open cell foam material.

* * * * *